US005168675A

United States Patent [19]

Shea, Sr.

[11] Patent Number: 5,168,675

[45] Date of Patent: Dec. 8, 1992

[54] POOL FOR MANUFACTURED STRUCTURE

[75] Inventor: James F. Shea, Sr., South Bend, Ind.

[73] Assignee: Fairmont Homes, Inc., Nappanee, Ind.

[21] Appl. No.: 702,928

[22] Filed: May 20, 1991

[51] Int. Cl.[5] ..... E04B 1/343

[52] U.S. Cl. ..... 52/64; 52/34; 52/67; 52/173 R; 4/592; 4/488

[58] Field of Search ..... 52/34, 64, 67, 79.5, 52/173 R; 4/592, 488, 494, 538, 548, 554, 495, 487, 488, 506

[56] References Cited

U.S. PATENT DOCUMENTS

| | | | |
|---|---|---|---|
| 2,237,272 | 4/1941 | Galbreath | 4/592 |
| 3,016,583 | 1/1962 | Grunt et al. | 52/67 |
| 3,107,116 | 10/1963 | Meaker | 52/67 |
| 3,662,410 | 5/1972 | Lankheet | 52/67 X |
| 4,720,949 | 1/1988 | Taylor | 4/488 X |

FOREIGN PATENT DOCUMENTS

| | | | |
|---|---|---|---|
| 0144744 | 11/1979 | Japan | 52/34 |
| 1520636 | 8/1978 | United Kingdom | 52/34 |

*Primary Examiner*—David A. Scherbel
*Assistant Examiner*—Kien Nguyen
*Attorney, Agent, or Firm*—Thomas J. Dodd

[57] ABSTRACT

A manufactured building structure which can be transported via road travel. The structure includes a pool, spa, or the like which can be shifted between a travel position inside the structure to a lowered operative position when the structure reaches its destination.

9 Claims, 5 Drawing Sheets

POOL FOR MANUFACTURED STRUCTURE

SUMMARY OF THE INVENTION

This invention relates to manufactured building structures and will have application to such a structure as equipped with a covered pool, spa, or similar structure.

The building structure of this invention is typically a transportable manufactured structure such as a mobile home, a vacation home, garden house, gazebo or the like. Such buildings can be moved and relocated via road travel. Heretofore, it has been impractical to construct such structures with a sunken tub or pool because of the road travel and the limited space in the structure.

This invention provides for a pool, hot tub or similar structure to be included in the manufactured building unit. The pool or hot tub liner is positioned inside the building unit and is supported atop the floor or the main frame of the building during road travel. When the building reaches its final destination, the supports are removed and the liner is lowered into an opening in the floor. Once secured, the liner can be supported either by the building floor or frame, or can rest directly on the ground beneath the building. An alternative construction has the liner bottom supported on a fixed frame support when the desired look is an indoor raised pool structure.

Accordingly, it is an object of this invention to provide for a transportable building structure which incorporates an interior pool or hot tub.

Another object is to provide a transportable building which has an indoor pool which can be rapidly shifted from a travel location inside the building to an operative location inside the building.

Another object is to provide for a pool or hot tub in a transportable building which does not detract from the living space of the building.

Other objects will become apparent upon a reading of the following description.

DESCRIPTION OF THE PREFERRED EMBODIMENTS

The preferred embodiments herein described are not intended to be exhaustive or to limit the invention to the precise forms disclosed. They are chosen and described to explain the principles of the invention and their application and practical use to allow others skilled in the art to follow their teachings.

Figure 1:
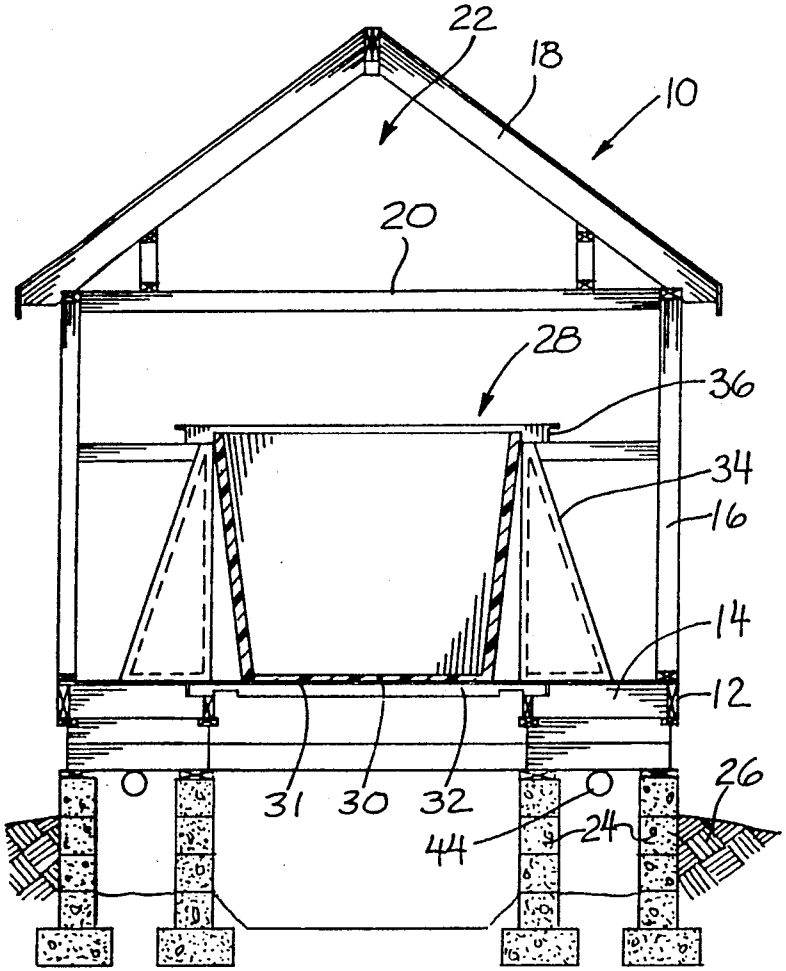
FIG. 1 is a cross-sectional view of a manufactured building with the pool liner in the shipping or road travel position.
Figure 2:
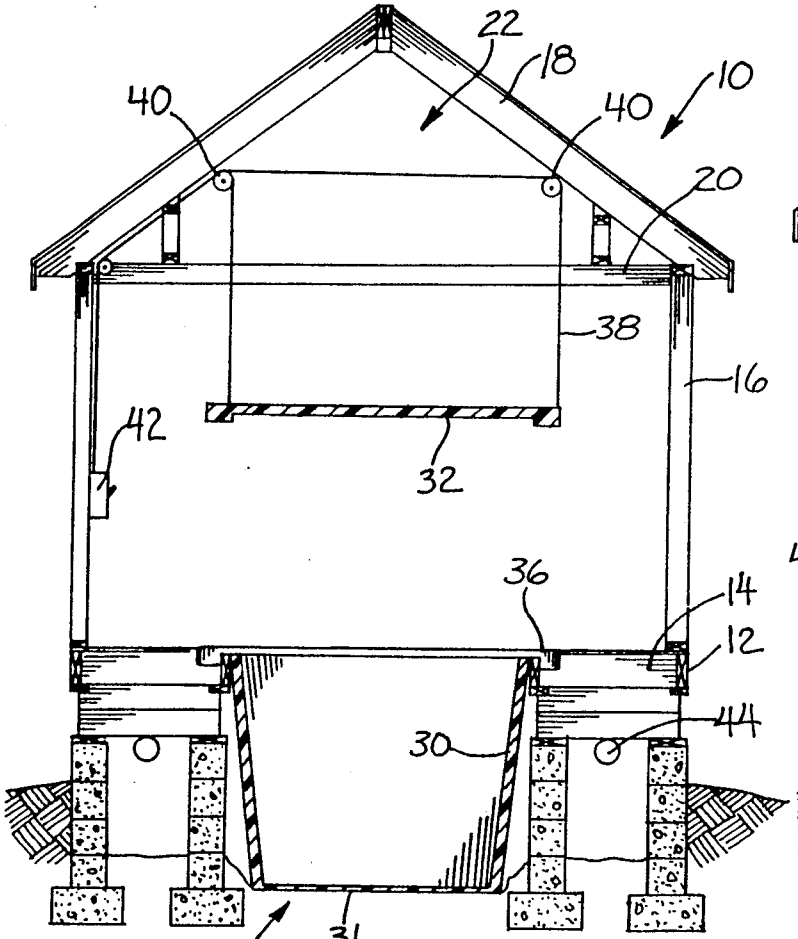
FIG. 2 is a cross-sectional view of the building of claim 1 with the pool liner in its lowered position and showing the removable floor.

Referring first to FIGS. 1 and 2, reference numeral 10 generally designates a building structure of the type described. Structure 10 shown is a manufactured house which is capable of being transported from the factory to a living site via road travel in a common manner.

Structure 10 as is common includes a lower support frame 12, floor 14, walls 16 and a roof 18. These components are common to nearly all structures which fit the standard industry definition of manufactured housing and will not be further described in detail. The structure 10 shown also includes ceiling 20 which in the unit shown defines a loft area 22 also common in the industry. Structure 10 will normally have a wheeled carriage (not shown) detachably fixed to the underside of frame 12 to promote road travel.

FIG. 1 illustrates structure 10 after initial house setup. As is common, support pilings 24 are anchored in the ground 26 to both support structure 10 and to prevent shifting. After the carriage (not shown) has been removed, structure 10 is normally lowered onto pilings 24 as by a lift crane and is then fixed to the pilings by fasteners (not shown). In the embodiment shown, the ground is excavated to a predetermined depth below the position of the hot tub or pool 28.

Pool 28 includes a liner 30 which defines the dimensions of the pool and will necessarily include plumbing, heaters, filters and/or pumps (not shown) which may be shipped either with structure 10 or separately for connection and set up at the site. During shipping, liner 30 rests atop and is supported by a removable floor section 32. Shipping dunnage 34 may be used to ensure the stability of liner 30 during road travel.

Liner 30 includes an upper peripheral lip 36 which may be of the generally squared S-shape configuration shown. If dunnage 34 is used, lip 36 is supported atop the dunnage 34 as shown in FIG. 1.

When structure 10 has reached the destination and been secured to pilings 24, pool 28 may be installed. Floor section 32 is removed, and liner 30 is lowered usually by a mechanical lift shown in FIG. 3 as cables 38, pulleys 40 and winch 42. Any acceptable method of lowering liner 30 can be employed without departing from the spirit of this invention.

As shown in FIG. 2, liner 30 is lowered into the opening in frame 12 formed by removing floor section 32 until lip 36 contacts floor 14. Liner 30 may be supported directly on the ground 26 as shown in FIG. 2, by lip 36 bearing on floor 14, or a combination of the two. Floor section 32 may be raised or lowered as shown depending on the desired use or non-use of pool 28. After pool liner 30 has been lowered into the position of FIG. 2, the plumbing 44 and other accessories (not shown) may be installed as desired to allow normal pool or hot tub use.

Figure 3:
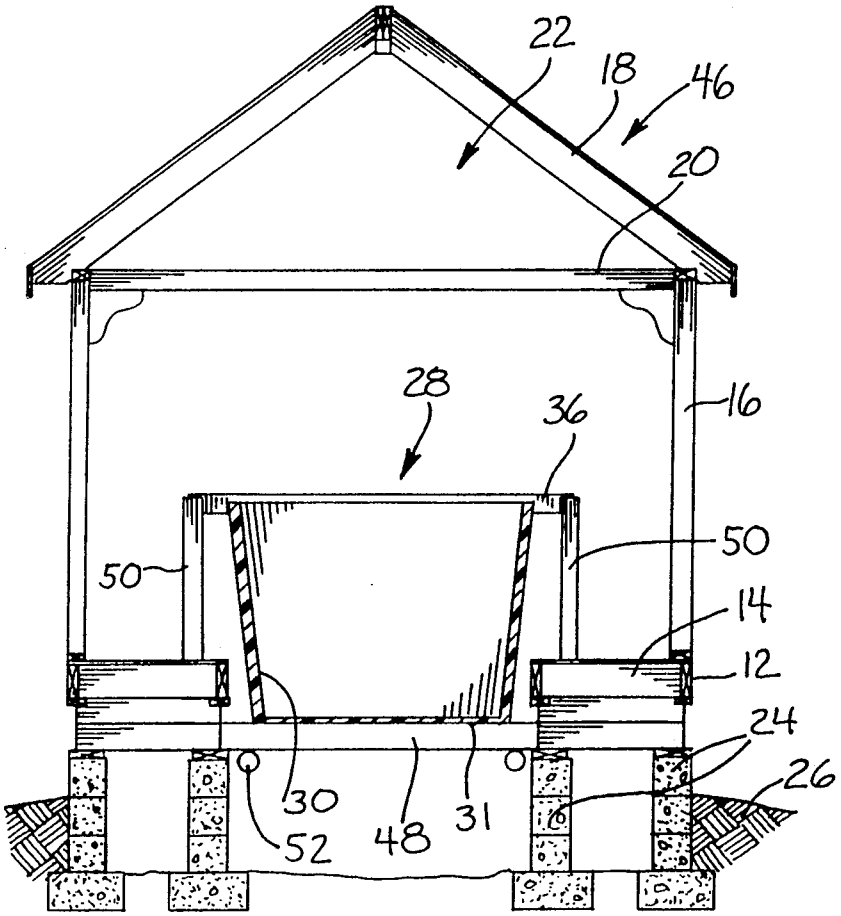
FIG. 3 is a cross-sectional view of a manufactured building with a raised (or above floor) pool liner in the lowered position.

FIG. 3 illustrates a modified structure 46. In this structure, frame 12 includes one or more fixed lower pool support 48 which support liner 30 if a raised pool or hot tub look is desired. Liner bottom 31 rests on and is supported by pool support 48. Lip 36 rests on peripheral support walls 50 which preferably surround the entire liner 30 and may be decorative to add a pleasing aesthetic appearance. In this embodiment, pool 28 is normally permanently secured in the position shown for both road travel and on-site use. Plumbing 52 and other accessories (not shown) can be installed at the factory or on-site.

Figure 4:
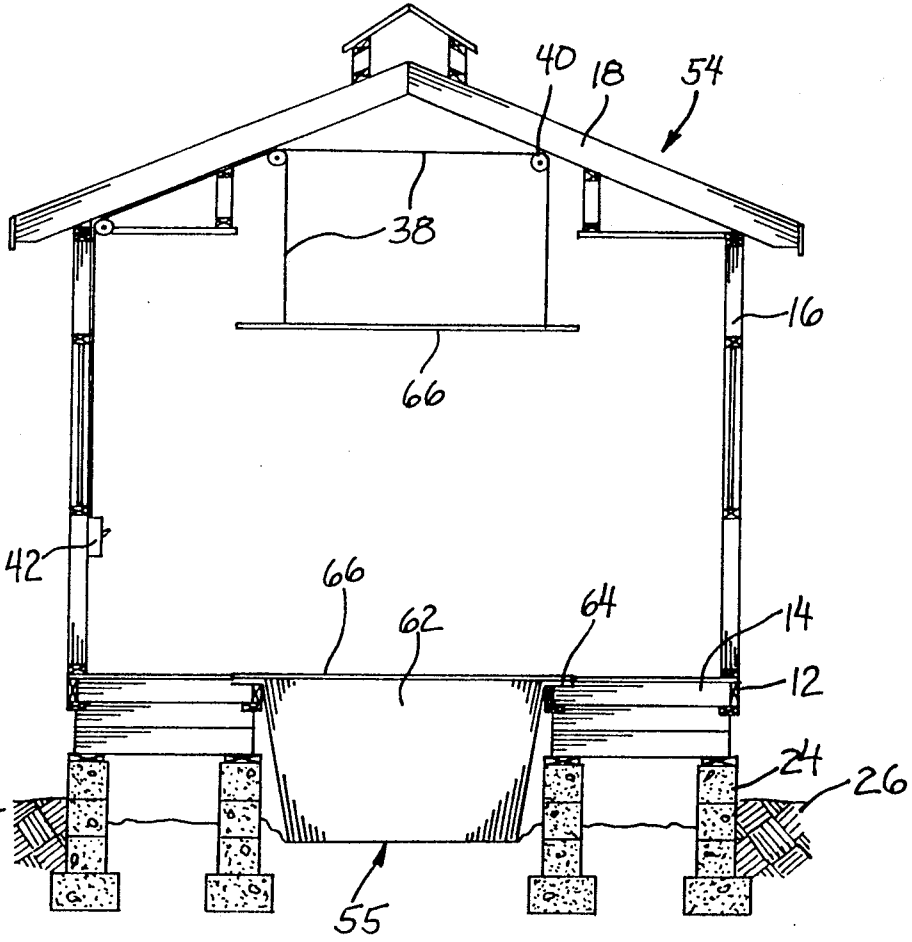
FIG. 4 is a cross-sectional view of a manufactured gazebo incorporating the pool of this invention in a lowered position.

FIG. 4 illustrates an alternative structure 54 for pool 55 which could be a gazebo, a swim house or similar structure. Structure 54 could be a stand alone unit such as with a gazebo or the garden-swim house 56 shown in FIG. 5, or can be incorporated into a common floor plan of a manufactured house 58 as shown in FIG. 6.

FIG. 4 illustrates pool 55 in the lowered position. Pool 55 includes liner 62 with a peripheral upper lip 64 and may be stored for road travel in much the same fashion as pool 28. When structure 54 reaches its intended destination, pool 55 is lowered in the same fashion as pool 28 with removable floor section 66 covering liner 62 when not in use. It should be noted that floor sections 32 and 66 could be of single piece or multiple piece construction.

The reference numerals used for the various other structural components of structures 10, 46 and structure 54 are identical to promote simplicity of description.

Figures 5, 6:
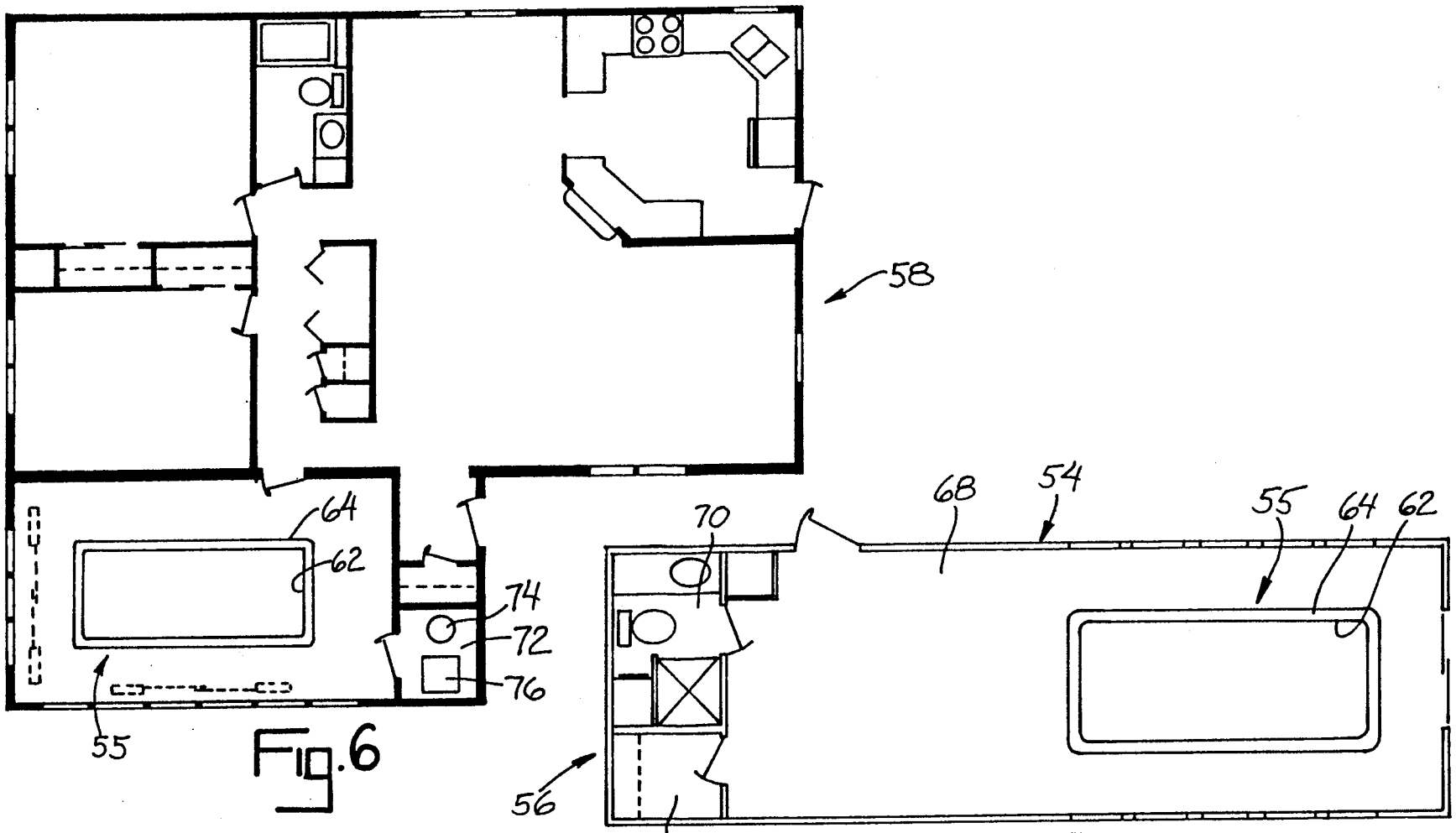
FIG. 5 is a top floor plan view of the garden and swim house building.
FIG. 6 is a top floor plan view of the building of FIG. 5 incorporated into a preexisting building.
Figure 7:
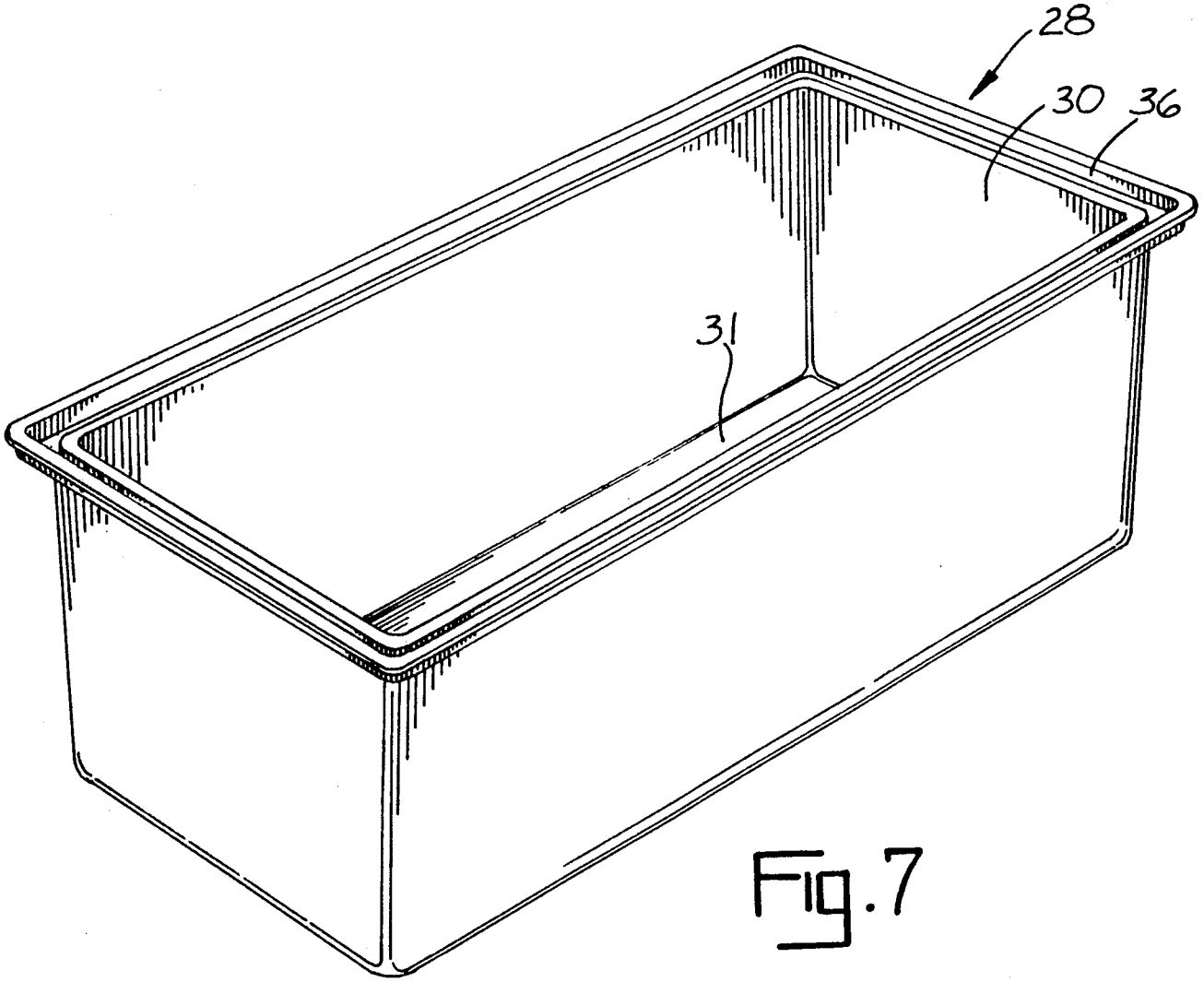
FIG. 7 is a perspective view of the pool.

FIGS. 5 and 6 illustrate structure 54 in floor plan views. FIG. 5 illustrates structure 54 as a stand-alone unit independent of any other structure and includes a main room 68 which houses pool 55. Structure 54 may also include bathroom 70 and utility room 72 which may be used to house the pool heater 74 and filter/pump 76 shown and referenced in FIG. 6. FIG. 6 illustrates structure 54 as an attachment to a preexisting manufactured house 58. Numerals from FIG. 6 are the same as in FIG. 5 for simplicity of description.

In all of the embodiments shown and described, pool 28 or 55 may be stored in the manufactured structure 10 or 54 for road travel purposes, then lowered into its operating position and connected to the plumbing at the destination site. In all instances, the pool 28 or 55 may be covered by removable floor sections 32 or 66 to allow the structure to assume a dual use depending on individual needs and desires.

Figure 8:
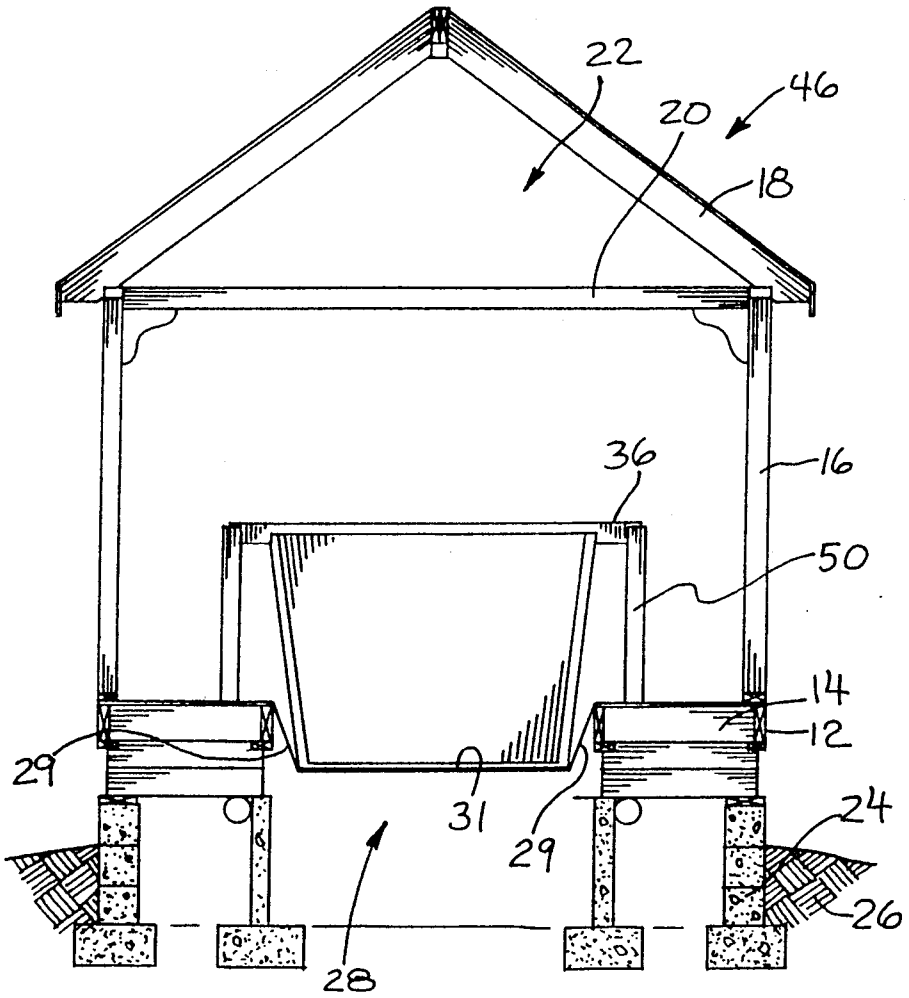
FIG. 8 is a sectional view similar to FIG. 3 with an alternative pool support shown.

FIG. 8 illustrates an alternative means of supporting pool 28 in building 46. In this embodiment, pool 28 is supported by flexible straps 29 (one shown) which are connected to floor 14 and extend under pool bottom 31.

It is understood that the above description does not limit the invention to the above given details, but may be modified within the scope of the following claims.

What is claimed is:

1. In combination, a manufactured building structure adapted for road travel from a factory to a destination, said structure including a support frame, upstanding walls, a roof and a floor to form an enclosure, and a pool structure adapted for use with said building, said pool structure including a liner stored in said building structure and supported therein during periods of road travel, said floor having a preformed hole for accommodating said liner and for allowing said linear to be lowered therethrough upon reaching a destination, and means for supporting said liner when so lowered.

2. The combination of claim 1 and a removable floor section covering said hole during periods of road travel, means for removing said removable floor section to allow said liner to be lowered.

3. The combination of claim 2 wherein said pool liner includes an upper continuous peripheral lip, said lip resting on said support frame when the liner is lowered to position the liner in said hole.

4. The combination of claim 3 and shipping dunnage packed about said liner during periods of road travel.

5. The combination of claim 3 wherein said floor includes a recess part wherein said lip resting in said recess, said removable floor section including a continuous downturned flange fitted in said recess whereby said removable floor section when installed is flush with said floor.

6. The combination of claim 2 wherein said frame includes a lower pool support, said liner resting on said supported by said pool support during periods of road travel.

7. The combination of claim 2 wherein said building structure is attached to a preexisting manufactured building structure.

8. The combination of claim 6 wherein said liner includes an upper continuous peripheral lip, a continuous wall positioned in said enclosure about said liner, said lip resting on said continuous wall.

9. The combination of claim 1 wherein said means for supporting includes a flexible strap connected to and spanning said hole, said liner resting on said strap and supported thereby when in its lowered position.

* * * * *